US011488525B2

(12) United States Patent
Qiu

(10) Patent No.: US 11,488,525 B2
(45) Date of Patent: Nov. 1, 2022

(54) DISPLAY PANEL DRIVING METHOD OF TURNING ON AN ACTIVE SWITCH CORRESPONDING TO EACH PIXEL OF THE DISPLAY PANEL FOR RELEASING CHARGES STORED IN THE DISPLAY PANEL DURING OPERATION, AND DRIVE CIRCUIT IMPLEMENTING THE SAME

(71) Applicant: HKC CORPORATION LIMITED, Shenzhen (CN)

(72) Inventor: Bin Qiu, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 823 days.

(21) Appl. No.: 16/319,483

(22) PCT Filed: Nov. 29, 2018

(86) PCT No.: PCT/CN2018/118047
§ 371 (c)(1),
(2) Date: Jan. 22, 2019

(87) PCT Pub. No.: WO2020/097991
PCT Pub. Date: May 22, 2020

(65) Prior Publication Data

US 2021/0335225 A1 Oct. 28, 2021

(30) Foreign Application Priority Data

Nov. 14, 2018 (CN) ..... 201811350600.5

(51) Int. Cl.
*G09G 3/3225* (2016.01)

(52) U.S. Cl.
CPC ... *G09G 3/3225* (2013.01); *G09G 2300/0814* (2013.01); *G09G 2330/027* (2013.01)

(58) Field of Classification Search
CPC ..... G09G 3/3225
See application file for complete search history.

(56) References Cited

U.S. PATENT DOCUMENTS 5,910,791 A 6/1999 Zimlich et al.
2003/0034965 A1* 2/2003 Kim ..... G09G 3/3696 345/211

(Continued)

FOREIGN PATENT DOCUMENTS

CN 1447306 A 10/2003
CN 101271671 A 9/2008

(Continued)

OTHER PUBLICATIONS

International Search Report issued in corresponding International application No. PCT/CN2018/118047, dated Aug. 20, 2019.

(Continued)

*Primary Examiner* — William Boddie
*Assistant Examiner* — Andrew B Schnirel

(57) ABSTRACT

Disclosed are a driving method for a display panel and a drive circuit. The drive circuit includes: a power circuit, configured to output a power-off signal; a pixel control circuit, configured to turn on an active switch corresponding to a pixel; and a power-off circuit, configured to close a display panel, where the pixel control circuit includes: a first logical circuit, configured to output a first control signal for turning off the active switch; a second logical circuit, configured to output a second control signal for turning on the active switch; and a switching circuit, configured to switch the first logical circuit and the second logical circuit, the active switch corresponding to the pixel being turned on when the display panel is closed.

5 Claims, 3 Drawing Sheets

(56) References Cited

U.S. PATENT DOCUMENTS

| | | | | |
|---|---|---|---|---|
| 2006/0290640 | A1* | 12/2006 | Park | G09G 3/3696 345/98 |
| 2008/0316195 | A1* | 12/2008 | Li | G09G 3/3677 345/212 |
| 2009/0058194 | A1* | 3/2009 | Lee | G09G 3/3685 307/130 |
| 2009/0231259 | A1 | 9/2009 | Yu et al. | |
| 2010/0033471 | A1* | 2/2010 | Liu | G09G 3/3685 345/212 |
| 2012/0113082 | A1* | 5/2012 | Lee | G09G 3/344 345/211 |
| 2014/0362042 | A1* | 12/2014 | Noguchi | G02F 1/1368 345/174 |

FOREIGN PATENT DOCUMENTS

| | | | |
|---|---|---|---|
| CN | 101299322 | A | 11/2008 |
| CN | 101364390 | A | 2/2009 |
| CN | 101540149 | A | 9/2009 |
| CN | 101739967 | A | 6/2010 |
| CN | 102222474 | A | 10/2011 |
| CN | 102522070 | A | 6/2012 |
| CN | 105185293 | A | 12/2015 |
| CN | 105469751 | A | 4/2016 |
| CN | 106097994 | A | 11/2016 |
| CN | 106952628 | A | 7/2017 |
| CN | 108231030 | A | 6/2018 |
| CN | 207781164 | U | 8/2018 |

OTHER PUBLICATIONS

Written opinion of the International Search Authority in corresponding International application No. PCT/CN2018/118047, dated Aug. 20, 2019.

First Office Action from China patent office in a counterpart Chinese patent Application 201811350600.5, dated Nov. 27, 2019 (8 pages).

* cited by examiner

DISPLAY PANEL DRIVING METHOD OF TURNING ON AN ACTIVE SWITCH CORRESPONDING TO EACH PIXEL OF THE DISPLAY PANEL FOR RELEASING CHARGES STORED IN THE DISPLAY PANEL DURING OPERATION, AND DRIVE CIRCUIT IMPLEMENTING THE SAME

This application claims the priority to the Chinese Patent Application No. CN201811350600.5, filed with National Intellectual Property Administration, PRC on Nov. 14, 2018 and entitled "DISPLAY PANEL DRIVING METHOD AND DRIVE CIRCUIT", which is incorporated herein by reference in its entirety.

TECHNICAL FIELD

This application relates to the field of display technology, and more particularly to a driving method for a display panel, and a drive circuit.

BACKGROUND

The description herein provides only background information related to this application, but does not necessarily constitute the existing technology.

With the development and progress of science and technology, flat panel displays become mainstream products of displays due to advantages such as thinness, power saving and low radiation, and are widely applied. The flat panel displays include a thin film transistor-liquid crystal display (TFT-LCD). People have strong demands for narrow-bezel televisions, and gate driver less (GDL) drivers emerged at the right moment are increasingly popular. The drive circuit splits an original gate drive chip into two parts: a boost chip arranged on a drive circuit board, and a shift register arranged on a panel. A signal is transmitted to the shift register by the boost chip to complete driving, and the frame length can be reduced.

When a display panel is closed, it cannot be ensured that all output channels are in an open state, and charges stored in the panel cannot be quickly released, which may prolong the time for closing the display panel or even cause picture abnormality.

SUMMARY

This application provides a driving method for a display panel, and a drive circuit, which ensure normal closing of a display panel.

To achieve the above objective, this application provides a driving method for a display panel, including the following steps:

outputting a power-off signal of a display panel;

turning on an active switch corresponding to a pixel; and closing the display panel.

Optionally, the step of outputting a power-off signal includes: outputting the power-off signal when a power voltage drops to a preset value.

Optionally, the step of turning on an active switch corresponding to a pixel includes: switching a low-level signal for driving the active switch to a high-level signal by using a switching circuit, and turning on the active switch corresponding to the pixel.

Optionally, the step of closing the display panel includes: receiving, by the display panel, the power-off signal, and closing the display panel.

This application also discloses a driving method for a display panel, including the following steps:

outputting a power-off signal of a display panel when a power voltage drops to a preset value;

switching a low-level signal for driving an active switch to a high-level signal by using a switching circuit, and turning on the active switch corresponding to a pixel; and closing the display panel.

This application also discloses a drive circuit of a display panel, including: a power circuit, configured to output a power-off signal; a pixel control circuit, configured to turn on an active switch corresponding to a pixel; and a power-off circuit, configured to close a display panel.

Optionally, the power circuit includes a power supply.

Optionally, a circuit control signal is output by the power supply.

Optionally, the circuit control signal includes a high-level signal, a low-level signal and a circuit switching signal.

Optionally, the active switch corresponding to the pixel is turned on through the circuit control signal.

Optionally, the pixel control circuit includes: a first logical circuit, configured to output a first control signal for turning off the active switch; a second logical circuit, configured to output a second control signal for turning on the active switch; and a switching circuit, configured to switch the first logical circuit and the second logical circuit, the switching circuit controlling the second logical circuit to be switched on to control the active switch to be turned on when the display panel is closed.

Optionally, the first logical circuit includes a first resistor, a second resistor and a first active switch, the first resistor being connected to the second resistor, the second resistor being connected to the switching circuit, a drain electrode of the first active switch being connected to a control end of the active switch, a gate electrode of the first active switch being connected between the first resistor and the second resistor, and the first active switch being connected to the power circuit.

Optionally, the switching circuit includes a third active switch, a source electrode of the third active switch being connected to the second resistor.

Optionally, the second logical circuit includes a third resistor, a fourth resistor and a second active switch, the third resistor being connected to the fourth resistor, the fourth resistor being connected to the switching circuit, a gate electrode of the second active switch being connected between the third resistor and the fourth resistor, and a drain electrode of the second active switch being connected to a control end of the active switch.

Optionally, the switching circuit includes a fourth active switch, a source electrode of the fourth active switch being connected to the fourth resistor.

Optionally, the switching circuit includes a third active switch, a fourth active switch and a logical power supply, a drain electrode of the third active switch being connected to the logical power supply, a source electrode of the third active switch being connected to the first logical circuit, and a source electrode of the fourth active switch being connected to the second logical circuit.

Optionally, the first logical circuit includes a first resistor, a second resistor and a first active switch, the first resistor being connected to the second resistor, a drain electrode of the first active switch being connected to a control end of the active switch, a gate electrode of the first active switch being connected between the first resistor and the second resistor, and the first active switch being connected to the power circuit; the second logical circuit includes a third resistor, a fourth resistor and a second active switch, the third resistor being connected to the fourth resistor, a gate electrode of the second active switch being connected between the third resistor and the fourth resistor, and a drain electrode of the second active switch being connected to a control end of the active switch; and the switching circuit includes a third active switch, a fourth active switch and a logical power supply, a drain electrode of the third active switch being connected to the logical power supply, a source electrode of the third active switch being connected to the second resistor, and a source electrode of the fourth active switch being connected to the fourth resistor.

Compared with a solution of directly raising an output point location voltage, this application adopts a new peripheral drive circuit, switches a low-level signal into a high-level signal when closing a display panel, turns on all active switches corresponding to a pixel, and opens all output channels, and charges stored in the panel may be quickly released, which ensures normal closing of the display panel.

BRIEF DESCRIPTION OF DRAWINGS

The accompanying drawings included are used for helping understand the embodiments of this application, constitute a part of this specification, illustrate examples of the embodiments of this application and, together with the description, serve to explain the principles of this application. Apparently, the accompanying drawings in the following description merely show some embodiments of this application, and persons of ordinary skill in the art may still derive other drawings from these accompanying drawings without creative effort. In the figures.

DETAILED DESCRIPTION

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right". "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly include one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

Figure 1:
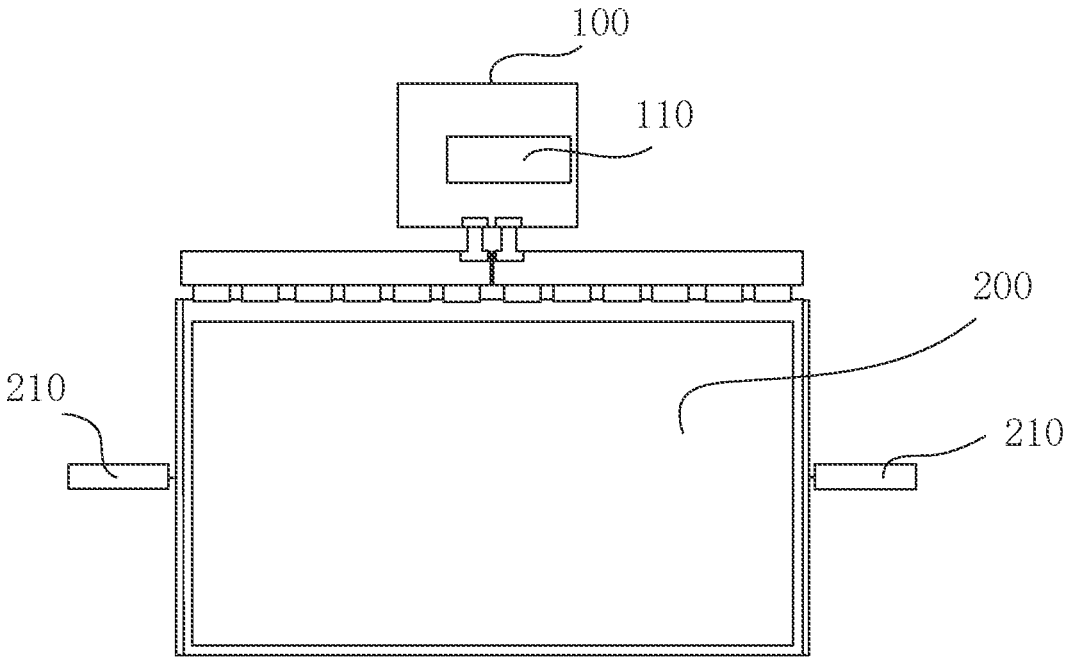
FIG. 1 is an exemplary schematic diagram of a drive circuit of a display panel.
Figure 2:
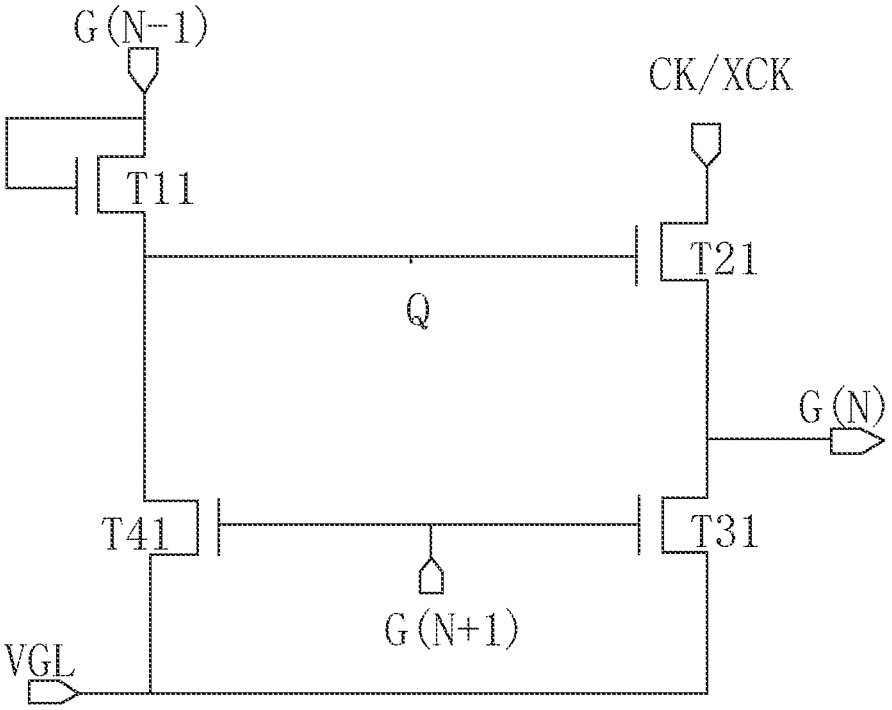
FIG. 2 is an exemplary schematic diagram of a drive circuit of a shift register.

As shown in FIG. 1 and FIG. 2, FIG. 1 is a novel gate driver less (GDL) driving architecture, and a gate IC is split into two parts: a boost chip 110 and a shift register 210, where the boost chip is arranged on a drive circuit board 100, the shift register 310 is arranged on the side of a panel display area 200, a drive signal is transmitted to the shift register through the boost chip 110 to complete driving, and this driving architecture may shorten the frame length of a display.

FIG. 2 is a drive circuit of a shift register, where T11, T21, T31 and T41 are metal oxide semiconductor (MOS) transistors, a previous row of output signal raises a Q point potential through T11, a CK/XCK signal charges a current row of G(N) through T21, and finally, when G(N+1) output is a high level, T31 and T41 are opened, and Q point and G(N) point potentials are both dropped. In this case, the charging and closing process of the G(N) row is completed. When the display panel is closed, a CK/XCK voltage is directly raised, but this way cannot ensure that all output channels are opened, which affects normal closing of the display panel.

This application is further described below with reference to the accompanying drawings and optional embodiments.

Figure 3:
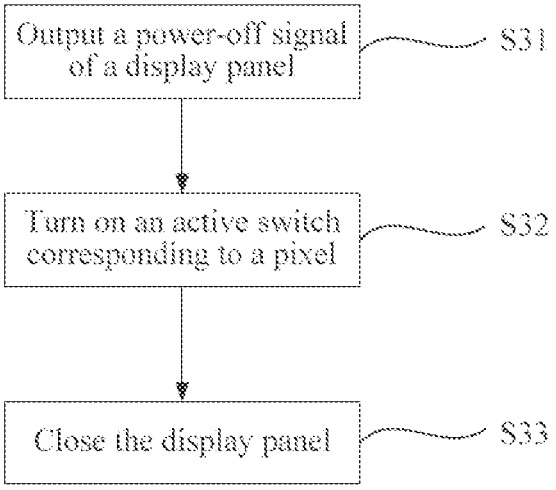
FIG. 3 is a flowchart of a driving method according to an embodiment of this application.
Figure 4:
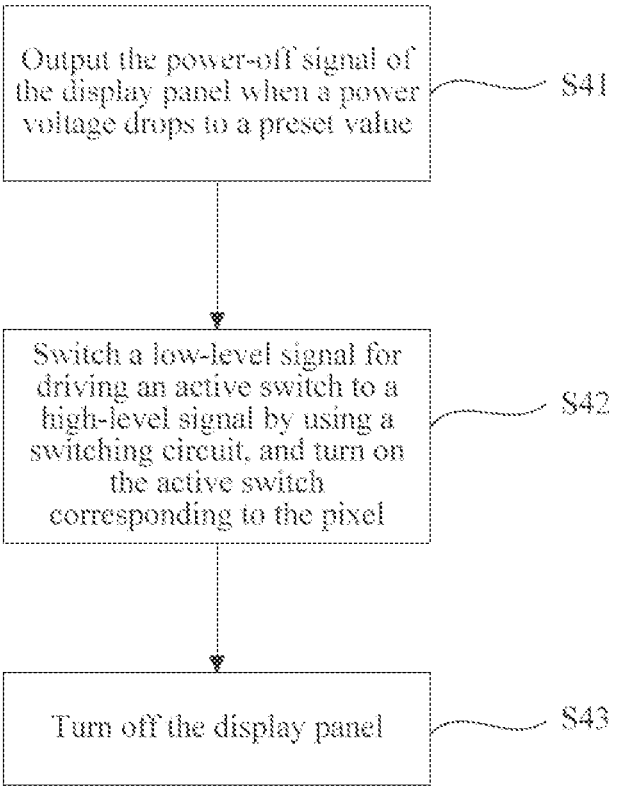
FIG. 4 is a flowchart of a driving method according to another embodiment of this application.

As shown in FIG. 3 and FIG. 4, an embodiment of this application discloses a driving method, including the steps:

S31: outputting a power-off signal of a display panel;

S32: turning on an active switch corresponding to a pixel; and

S33: closing the display panel.

In this solution, a novel gate driver less (GDL) architecture are increasingly applied to narrow-bezel design of a television, and a GDL circuit splits an original gate drive chip into a boost chip and a shift register. When the display panel is closed, CK/XCK is directly raised, but this mode cannot ensure that all output channels corresponding to a pixel are in an open state, and cannot quickly release charges stored in the panel, which affects picture closing of the display panel. This application adopts a new driving method, turns on all active switches corresponding to a pixel when receiving a power-off signal. In this case, all output channels are opened, and charges stored in the panel may be quickly released, which ensures normal closing of the display panel.

In embodiments, S41: output a power-off signal of a display panel when a power voltage drops to a preset value.

In this solution, a power voltage input generally is 12 V. Here, a preset value is set for the power voltage, when the value of the power voltage drops to the preset value, it is determined that the display panel is a closing state currently, and a power-off signal is output. In practical application, the preset value does not follow a definite standard, and is set to range from 8 to 9 V generally.

In embodiments, S42: switch a low-level signal for driving the active switch to a high-level signal by using a switching circuit, and turn on the active switch corresponding to the pixel.

In this solution, when the circuit outputs a power-off signal, the switching circuit switches a low-level signal for driving the active switch into a high-level signal. In this case, all active switches corresponding to the pixel are turned on, all output channels are opened when the display panel is closed, and the release of charges in the panel is accelerated.

In embodiments, the step of closing the display panel includes: receiving, by the display panel, the power-off signal, and closing the display panel.

In this solution, after the display panel receives the power-off signal, the display panel is closed, thereby ensuring normal closing of the display panel.

As shown in FIG. 4, as another embodiment of this application, a driving method is disclosed, which includes the following steps:

S41: outputting a power-off signal of a display panel when a power voltage drops to a preset value:

S42: switching a low-level signal for driving an active switch to a high-level signal by using a switching circuit, and turning on the active switch corresponding to a pixel; and S43: closing the display panel.

In this solution, a preset value is set when the display panel is closed. After the preset value is set, when a power voltage reaches the preset value, it is determined that the display panel is in a closed state, and in this case, a power-off signal is output. Then, the switching circuit switches the output signal from an original low-level signal into a high-level signal, an active switch corresponding to a pixel is turned on, all output channels are opened, and charges stored in the panel are quickly released, which ensures normal closing of the display panel.

Figure 5:
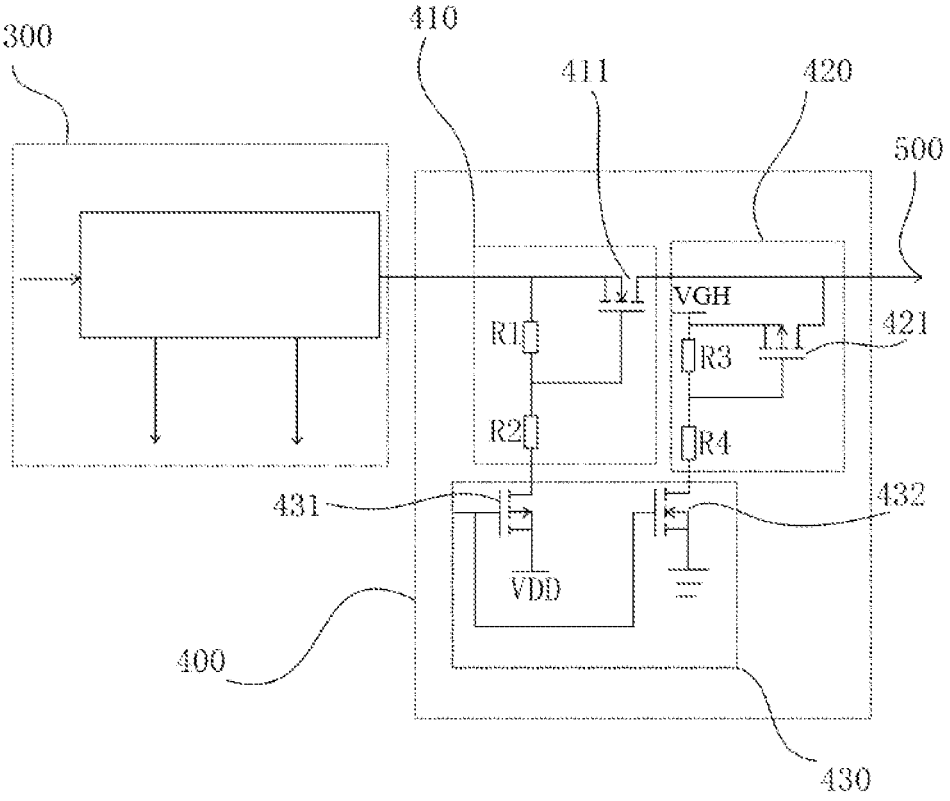
FIG. 5 is a schematic diagram of a drive circuit according to another embodiment of this application.

As shown in FIG. 5, as another embodiment of this application, a drive circuit is disclosed, which includes: a power circuit 300, configured to output a power-off signal: a pixel control circuit 400, configured to turn on an active switch corresponding to a pixel; and a power-off circuit, configured to close a display panel.

In this solution, the drive circuit includes a power circuit 300, a pixel control circuit 400 and a power-off circuit, where the pixel control circuit 400 is the core of this drive circuit. By means of the pixel drive circuit 400, the active switch corresponding to the pixel can be turned on, and it is ensured that charges in the panel are quickly released, thus ensuring normal closing of the display panel.

In embodiments, the power circuit 300 includes a power supply, through which a circuit control signal is output.

In this solution, an internal voltage is distributed to each circuit through the power supply, and the circuit control signal output by the power supply controls the whole circuit of the display panel.

In embodiments, the circuit control signal includes a high-level signal, a low-level signal and a circuit switching signal.

In this solution, the high-level signal and the low-level signal are switched by the drive circuit, thus ensuring normal closing of the display panel.

In embodiments, the active switch corresponding to the pixel is turned on through the circuit control signal.

In this solution, the circuit control signal is actually a turn-on/off signal of the active switch corresponding to the pixel, and the active switch corresponding to the pixel is turned on or off through the circuit control signal.

In embodiments, the pixel control circuit 400 includes: a first logical circuit 410, configured to output a first control signal for turning off the active switch, the first logical circuit being a low-level circuit, and the output first control signal being a low-level signal; a second logical circuit 420, configured to output a second control signal for turning on the active switch, the second logical circuit being a high-level circuit, and the output second control signal being a high-level signal; and a switching circuit 430, configured to switch the first logical circuit 410 and the second logical circuit 420, the switching circuit 430 controlling the second logical circuit 430 to be switched on to control the active switch to be turned on when the display panel is closed.

In this solution, when the power circuit 300 detects that the voltage drops to the preset value, it is determined that the display panel is in a closed state currently, and a power-off signal is sent. The switching circuit 430 switches the first logical circuit 410 into the second logical circuit 430, the switching circuit 430 is controlled to be switched on, and a high-level signal namely a VGH signal is output. As the high-level signal is output, the active switch is turned on.

In embodiments, the first logical circuit 410 includes a first resistor R1, a second resistor R2 and a first active switch 411, where the first resistor R1 is connected to the second resistor R2, the second resistor R2 is connected to the switching circuit 430, a drain electrode of the first active switch 411 is connected to a control end 500 of the active switch, a gate electrode of the first active switch 411 is connected between the first resistor R1 and the second resistor R2, and the first active switch 411 is connected to the power circuit 300.

In this solution, the first active switch 411 of the first logical circuit 410 is an N-type metal oxide semiconductor (MOS) transistor, where the drain electrode of the first active switch 411 is connected to the control end 500 of the active switch, a wire between the first resistor R1 and the second resistor R2 is connected to the gate electrode of the first active switch 411, and a voltage between the first resistor R1 and the second resistor R2 is V1. When the switching circuit 430 is at a low level, V1 is greater than a low-level voltage, the first active switch 411 is turned on, and a low-level signal is output; and when the switching circuit 430 is at a high level, V1 is equal to the low-level voltage, in this case, the first active switch 411 is turned off, and a low-level signal may not be output.

In embodiments, the switching circuit 430 includes a third active switch 431, a source electrode of the third active switch 431 being connected to the second resistor R2.

In this solution, the second resistor R2 in the first logical circuit 410 is connected to the switching circuit 430, and actually, the second resistor R2 is connected to the source electrode of the third active switch 431.

In embodiments, the second logical circuit 420 includes a third resistor R3, a fourth resistor R4 and a second active switch 421, where the third resistor R3 is connected to the fourth resistor R4, the fourth resistor R4 is connected to the switching circuit 430, a gate electrode of the second active switch 421 is connected between the third resistor R3 and the fourth resistor R4, and a drain electrode of the second active switch 421 is connected to a control end 500 of the active switch.

In this solution, the second active switch 421 of the second logical circuit 420 is a P-type metal oxide semiconductor (MOS) transistor, where similar to the first active switch 411, the gate electrode of the second active switch 421 is connected between the third resistor R3 and the fourth resistor R4, and a voltage between the third resistor R3 and the fourth resistor R4 is V2. When the switching circuit 430 is at a low level, V2 is equal to a high-level voltage, the second active switch 421 is turned off, and a high-level signal may not be output; and when the switching circuit 430 is a high level, V2 is smaller than the high-level voltage, the second active switch 421 is turned on, a high-level signal is output, and in this case, the active switch is turned on, and all output channels are opened.

In embodiments, the switching circuit 430 includes a fourth active switch 432, a source electrode of the fourth active switch 432 being connected to the fourth resistor R4.

In this solution, the fourth resistor R4 in the second logical circuit 410 is connected to the switching circuit 430, and actually, the fourth resistor R4 is connected to the source electrode of the fourth active switch 432.

In embodiments, the switching circuit 430 includes a third active switch 431, a fourth active switch 432 and a logical power supply VDD, a drain electrode of the third active switch 431 being connected to the logical power supply VDD, a source electrode of the third active switch 431 being connected to the first logical circuit 410, and a source electrode of the fourth active switch 432 being connected to the second logical circuit 420.

In this solution, the third active switch 431 in the switching circuit is a P-type metal oxide semiconductor (MOS) transistor, the fourth active switch 432 is an N-type metal oxide semiconductor (MOS) transistor, and the gate electrode of the third active switch 431 is connected to the gate electrode of the fourth active switch 432. The logical power supply VDD is 3.3 V, and adopts a working voltage of a logical circuit in a general chip. The third active switch 431 and the fourth active switch 432 are connected to the corresponding circuits respectively.

In embodiments, the first logical circuit 410 includes a first resistor R1, a second resistor R2 and a first active switch 411, where the first resistor R1 is connected to the second resistor R2, a drain electrode of the first active switch 411 is connected to a control end 500 of the active switch, a gate electrode of the first active switch 411 is connected between the first resistor R1 and the second resistor R2, and the first active switch 411 is connected to the power circuit 300; the second logical circuit 420 includes a third resistor R3, a fourth resistor R4 and a second active switch 421, where the third resistor R3 is connected to the fourth resistor R4, a gate electrode of the second active switch 421 is connected between the third resistor R3 and the fourth resistor R4, and a drain electrode of the second active switch 421 is connected to a control end 500 of the active switch; and the switching circuit 430 includes a third active switch 431, a fourth active switch 432 and a logical power supply VDD, a drain electrode of the third active switch 431 being connected to the logical power supply VDD, a source electrode of the third active switch 431 being connected to the second resistor R2, and a source electrode of the fourth active switch 432 being connected to the fourth resistor R4.

In this solution, the first active switch 411 and the fourth active switch 432 are N-type metal oxide semiconductor (MOS) transistors, and the second active switch 421 and the third active switch 431 are P-type metal oxide semiconductor (MOS) transistors. When this circuit operates, under a normal state, the switching circuit 430 is at a low level. In this case, the third active switch 431 is turned on, and the fourth active switch 432 is turned off. In this case, the logical power supply VDD is communicated with the first logical circuit 410 through the third active switch 431, the first resistor R1 and the second resistor R2, and a voltage V1 between the first resistor R1 and the second resistor R2 is greater than a low-level voltage, thus resulting in that the first active switch 411 is turned on, a low-level signal is output through the first active switch 411, the fourth active switch 432 is turned off, a voltage V2 between the third resistor and the fourth resistor R4 is equal to a high-level voltage, the third active switch 431 is also turned off, and a high-level signal may not be output. When the switching circuit 430 is at a high level, the third active switch 431 is turned off, the fourth active switch 432 is turned on, in this case, V1 is equal to the low-level voltage, the low-level signal may not be output, meanwhile, the fourth active switch 432 is turned on, V2 is smaller than the high-level voltage, the second active switch 421 is turned on, the high-level signal is output, the original low-level signal is switched into the high-level signal, an active switch corresponding to a pixel is turned on, and the release of charges is accelerated.

Figure 6:
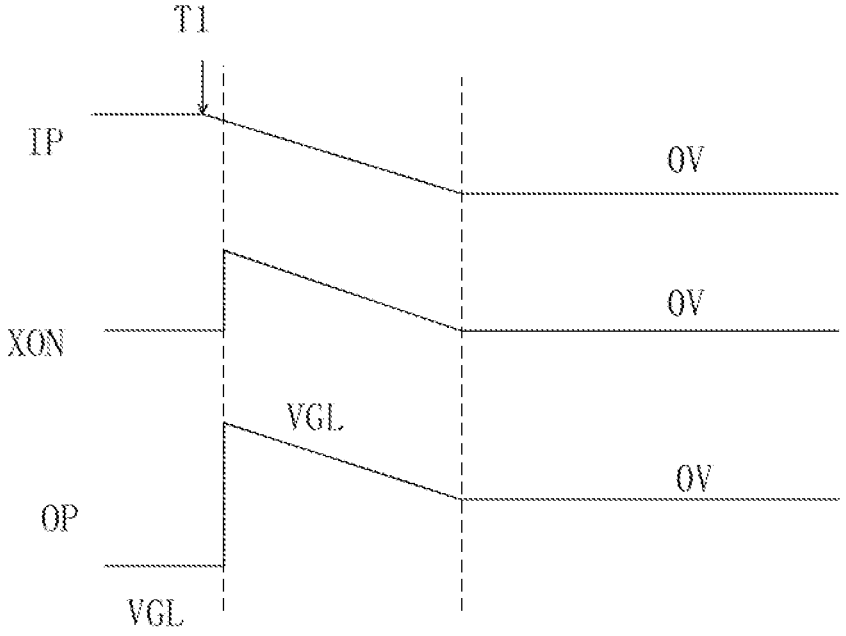
FIG. 6 is a schematic diagram of a voltage signal of a drive circuit according to another embodiment of this application.

As shown in FIG. 6, FIG. 6 is a diagram of a voltage variation when a display panel is closed by a drive circuit according to this application, where T1 is a closing start time of the display panel, IP is an input power (IP) voltage, OP is an output (OP) signal voltage, XON is a signal output by the switching circuit 430, VGL is a low-level signal voltage, and VGH is a high-level signal voltage. When closing of the display panel is started, IP starts to be reduced, when the IP reaches to a preset value, an XON signal is switched from a low level to a high level, and circuit output is also converted from VGL to VGH, so that the voltage reduction is ensured to a greater extent until it drops to 0 V, all charges in the panel are completely released, and the closing of the display panel is completed.

It should be noted that the sequence numbers of steps involved in a specific solution should not be considered as limiting the order of steps as long as the implementation of this solution is not affected. The steps appearing earlier may be executed earlier than, later than, or at the same time as those appearing later. Such implementations shall all be considered as falling within the protection scope of this application as long as this solution can be implemented.

The technical solutions of this application can be widely applied to various display panels, such as twisted nematic (TN) panels, in-plane switching (IPS) panels, and multi-domain vertical alignment (VA) panels. Certainly, other suitable types of display panels such as organic light-emitting diode (OLED) display panels are also applicable to the above solutions.

The foregoing contents are detailed descriptions of this application in conjunction with specific optional embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A drive circuit of a display panel, comprising:

a power circuit, configured to output a power-off signal;

a pixel control circuit, configured to turn on an active switch corresponding to each pixel of the display panel in response to the power-off signal and releasing charges stored in the display panel during operation ensuring normal turn-off of the display panel; and a power-off circuit, configured to turn off the display panel;

wherein the pixel control circuit comprises: a first logical circuit, configured to output a first control signal for turning off the active switch corresponding to each pixel of the display panel when the display panel is operating; a second logical circuit, configured to output a second control signal for turning on the active switch corresponding to each pixel of the display panel when the display panel is turned oft and a switching circuit, configured to switch between the first logical circuit and the second logical circuit; wherein the switching circuit is configured to control the second logical circuit to be switched on to control the active switch corresponding to each pixel to be turned on simultaneously when the display panel is turned off;

wherein the first logical circuit comprises a first resistor, a second resistor, and a first active switch, wherein one end of the first resistor is directly connected to one end of the second resistor, a drain electrode of the first active switch is directly connected to a control end of the active switch corresponding to each pixel of the display panel, a gate electrode of the first active switch is directly connected between the first resistor and the second resistor, and a source electrode of the first active switch is directly connected to the power circuit and directly to another end of the first resistor; the second logical circuit comprises a third resistor, a fourth resistor, and a second active switch, wherein one end of the third resistor is directly connected to one end of the fourth resistor, a gate electrode of the second active switch is directly connected between the third resistor and the fourth resistor, and a drain electrode of the second active switch is directly connected to a control end of the active switch corresponding to each pixel of the display panel, and a source electrode of the second active switch is directly connected to a high-level signal VGH; and the switching circuit comprises a third active, switch, a fourth active switch, and a logical power supply VDD, wherein a drain electrode of the third active switch is directly connected to the logical power supply VDD, a source electrode of the third active switch is directly connected to the other end of the second resistor away from the first resistor, and a source electrode of the fourth active switch is directly connected to the other end of the fourth resistor away from the third resistor; wherein a gate electrode of the fourth active switch is directly connected to a gate electrode of the third active switch, and a drain electrode of the fourth active switch is directly connected to ground GND;

wherein the drain electrode of the first active switch is directly connected to the drain electrode of the second active switch;

wherein when the display panel is operating under a normal state, a low voltage level is input to a gate electrode of the third active switch, which is thus turned on so that the logical power supply VDD is communicated with the first logical circuit through the third active switch, the first resistor, and the second resistor, and so a voltage V1 between the first and second resistors is greater than a low-level voltage so that the first active switch is turned on, and a low-level signal is output throe h the first active switch; meanwhile, the fourth active switch is turned off, a voltage V2 between the third and fourth resistors is equal to a high-level voltage due to the high-level signal VGH so that the second active switch is also turned off and a high-level signal is not output; and wherein when the display panel is being turned off a high voltage level is input to the gate electrode of the third active switch which is thus turned off and the voltage V1 is equal to a low-level voltage so that the low-level signal is not able to be output; meanwhile, the fourth active switch is turned on so that V2 is smaller than the high-level voltage because it is pulled down by the ground GND, so that the second active switch is turned on, and the high-level signal VGH is output to the active switch corresponding to each pixel of the display panel, which is turned on accelerating the release of charges stored in the display panel.

2. The drive circuit according to claim 1, wherein the power circuit comprises a power supply.

3. The drive circuit according to claim 2, wherein a circuit control signal is output by the power supply.

4. The drive circuit according to claim 3, wherein the circuit control signal comprises a high-level signal, a low-level signal and a circuit switching signal.

5. The drive circuit according to claim 3, wherein the active switch corresponding to each pixel is turned on through the circuit control signal.

* * * * *